US007368036B2

(12) United States Patent
Tolan et al.

(10) Patent No.: US 7,368,036 B2
(45) **Date of Patent: *May 6, 2008**

(54) XYLANASE TREATMENT OF CHEMICAL PULP

(75) Inventors: Jeffrey S. Tolan, Ontario (CA); Corina Popovici, Ontario (CA)

(73) Assignee: Iogen Bio-Products Corporation, Ontario (CA)

( * ) Notice: Subject to any disclaimer, the term of this patent is extended or adjusted under 35 U.S.C. 154(b) by 0 days.

This patent is subject to a terminal disclaimer.

(21) Appl. No.: 10/505,815

(22) PCT Filed: Mar. 5, 2003

(86) PCT No.: PCT/CA03/00300

§ 371 (c)(1),
(2), (4) Date: Oct. 13, 2004

(87) PCT Pub. No.: WO03/074780

PCT Pub. Date: Sep. 12, 2003

(65) Prior Publication Data

US 2005/0150619 A1 Jul. 14, 2005

Related U.S. Application Data

(60) Provisional application No. 60/362,200, filed on Mar. 6, 2002.

(51) Int. Cl.
*D21C 9/10* (2006.01)
*D21C 9/14* (2006.01)

(52) U.S. Cl. ..... 162/73; 162/67; 162/88; 162/65; 162/78; 162/72

(58) Field of Classification Search ..... 162/72–73, 162/60, 65–67, 74, 78, 87–88; 435/200, 435/277, 278; 8/116.1
See application file for complete search history.

(56) References Cited

U.S. PATENT DOCUMENTS

| | | | | |
|---|---|---|---|---|
| 5,179,021 | A * | 1/1993 | du Manoir et al. | 435/278 |
| 5,405,769 | A | 4/1995 | Campbell et al. | |
| 5,503,709 | A * | 4/1996 | Burton | 162/6 |
| 5,591,304 | A * | 1/1997 | Tolan et al. | 162/60 |
| 5,618,386 | A * | 4/1997 | Arbeloa et al. | 162/72 |
| 5,645,686 | A | 7/1997 | Troughton et al. | |
| 5,759,840 | A | 6/1998 | Sung et al. | |
| 5,916,795 | A | 6/1999 | Fukunaga et al. | |
| 5,935,836 | A * | 8/1999 | Vehmaanpera et al. | 435/200 |
| 6,258,208 | B1 * | 7/2001 | Lindeberg et al. | 162/65 |
| 6,830,655 | B2 * | 12/2004 | Siika-Aho et al. | 162/72 |
| 7,320,741 | B2 * | 1/2008 | Tolan et al. | 162/73 |
| 2003/0166236 | A1 * | 9/2003 | Sung | 435/200 |
| 2004/0069426 | A1 * | 4/2004 | Siika-Aho et al. | 162/72 |
| 2004/0077071 | A1 * | 4/2004 | Tolan et al. | 435/278 |
| 2004/0112555 | A1 * | 6/2004 | Tolan et al. | 162/72 |
| 2005/0150619 | A1 * | 7/2005 | Tolan et al. | 162/72 |
| 2005/0214410 | A1 | 9/2005 | White et al. | |

FOREIGN PATENT DOCUMENTS

| | | | |
|---|---|---|---|
| EP | 0 383 999 | A2 | 8/1990 |
| EP | 0 386 888 | A2 | 9/1990 |
| GB | 2 248 075 | A | 3/1992 |
| WO | WO 89/08738 | | 9/1989 |
| WO | WO 91/02840 | | 3/1991 |
| WO | WO 91/05908 | | 5/1991 |
| WO | WO 9111553 | A1 * | 8/1991 |
| WO | WO 92/07998 | | 5/1992 |
| WO | WO 9207998 | A1 * | 5/1992 |
| WO | WO 92/21813 | | 12/1992 |
| WO | WO 01/92487 | A2 | 12/2001 |
| WO | WO 02052100 | A2 * | 7/2002 |
| WO | WO 02057541 | A2 * | 7/2002 |
| WO | WO 03048449 | A1 * | 6/2003 |
| WO | WO 03074780 | A1 * | 9/2003 |

OTHER PUBLICATIONS

Chlorine Dioxide Generation, published by Paprican, Pointe Claire, Quebec (1993).

Ericksson, K.E.L., "Biotechnology in the pulp and paper industry," *Wood Science and Technology*, vol. 24 (1990), pp. 79-101.

Lever, M., "A New Reaction for Colorimetric Determination of Carbohydrates," *Analytical Biochemistry*, vol. 47 (1972), pp. 273-279.

Lüthi, Ernst, et al., "Xylanase from the Extremely Thermophilic Bacterium '*Caldocellum saccharolyticum*': Overexpression of the Gene in *Escherichia coli* and Characterization of the Gene Product," *Applied and Environmental Microbiology*, vol. 56, Sep. 1990, pp. 2677-2683.

Paice, M. G., et al., "Viscosity-Enhancing Bleaching of Hardwood Kraft Pulp with Xylanase from a Cloned Gene," *Biotechnology and Bioengineering*, vol. 32 (1988), pp. 235-239.

(Continued)

*Primary Examiner*—José A. Fortuna
(74) *Attorney, Agent, or Firm*—Fitzpatrick, Cella, Harper & Scinto

(57) ABSTRACT

The present invention discloses methods of bleaching chemical pulp that use xylanase enzymes after chemical bleaching. The method comprises the steps of carrying out a chlorine dioxide stage to produce a partially bleached pulp, treating the partially bleached pulp with a xylanase enzyme, optionally in the presence of oxygen and hydrogen peroxide, in a mild extraction stage, then bleaching the pulp with a second chlorine dioxide stage. The method allows the mill to decrease the usage of sodium hydroxide or other alkali, while decreasing the use of chlorine dioxide, and possibly improving the yield and strength of the pulp, while maintaining a similar level of bleached brightness of the pulp. The pulp bleaching method of the present invention may be performed in a pulp mill as part of a complex pulp bleaching process.

4 Claims, No Drawings

OTHER PUBLICATIONS

PAPTAC Bleaching Committee, Glossary of Bleaching Terms (1996).

PAPTAC-Standard Testing Methods, "Standard E.1: Brightness of Pulp, Paper and Paperboard" (1990).

Pommier, Jean-Claude, et al., "Using enzymes to improve the process and the product quality in the recycled paper industry, Part 1: the basic laboratory work," *Tappi Journal*, Jun. 1989, pp. 187-191.

Shah, A.K., et al., "Xylanase Treatment of Oxygen-Bleached Hardwood Kraft Pulp at High Temperature and Alkaline pH Levels Gives Substantial Savings in Bleaching Chemicals," *Journal of Pulp and Paper Science*, vol. 26, No. 1, Jan. 2000, pp. 8-11.

Simpson, Helen D., et al., "An extremely thermostable xylanase from the thermophilic eubacterium *Thermotoga," Biochem. J.,* (1991) 277, 413-417.

TAPPI Test Method T 210, "Sampling and Testing Wood Pulp Shipments for Moisture" (1993).

TAPPI Test Method T236 cv-85, "Kappa number of pulp" (1993).

Winterhalter, Christoph, et al., "Two Extremely Thermostable Xylanases of the Hyperthermophilic Bacterium *Thermotoga maritima* MSB8," *Applied and Environmental Microbiology*, vol. 61, May 1995, pp. 1810-1815.

Wong, K.K.Y., et al., "Xylanase Pre- and Post-Treatments of Bleached Pulps Decrease Absorption Coefficient," *Journal of Pulp and Paper Science*, vol. 26, No. 10, Oct. 2000, pp. 377-383.

International Search Report, dated May 19, 2003, for corresponding International Application No. PCT/CA03/00300.

International Preliminary Examination Report, dated Apr. 22, 2004, for corresponding International Application No. PCT/CA03/00300.

* cited by examiner

XYLANASE TREATMENT OF CHEMICAL PULP

This application is the U.S. National Stage of International Application No. PCT/CA03/00300, filed Mar. 5, 2003, published in English, which claims the benefit of U.S. provisional application No. 60/362,200, filed Mar. 6, 2002.

The invention relates to methods of bleaching pulp. More specifically the invention relates to methods of bleaching pulp using xylanase enzymes.

BACKGROUND OF THE INVENTION

The production of bleached chemical pulp is a major industry around the world. More than 50 million tons of bleached pulp is produced annually. Bleached chemical pulp is the largest component of all types of white paper, including that used in photocopy paper, writing paper, and paper packaging. In addition, bleached chemical pulp is also used to impart strength to less expensive grades of paper, such as newsprint. Bleached chemical pulp has large markets because of its high degree of whiteness and cleanliness, the stability of the whiteness, its high strength, and the ease and uniformity of the printing surface it provides. These attributes are obtained when lignin, which is colored and decreases the interfiber bonding of the cellulose, is almost completely removed from the pulp.

In the process of chemical pulping, the furnish (or feedstock) primarily consists of wood chips which are added to a reaction chamber, known as a digester, and are treated with chemicals to dissolve lignin in the pulp. There are several chemical pulping processes known in the art. Two of the major chemical pulping processes are kraft pulping, in which the pulp is cooked in alkaline liquor, and sulfite pulping, in which the pulp is cooked in acidic liquor. Both kraft pulping and sulfite pulping may be performed in batch or continuous digestors.

One of the main purposes of the pulping process is to release lignin which binds cellulose fibers in the feedstock. Pulping dissolves 85% to 95% of the lignin in the feedstock material. Following the pulping stage, the pulp is washed with water to remove dissolved lignin.

While pulping removes most of the lignin in the feedstock material, it is not capable of removing all the lignin without destroying the cellulose fibers of the feedstock. The remaining lignin is removed from the pulp by bleaching.

A pulp bleaching process may consist of many stages. For example, following pulping, a pulp bleaching process may comprise an alkaline oxygen delignification stage (O), an enzymatic treatment stage (X), one or more chlorine dioxide stages (D), and one or more alkaline extraction stages (E). A pulp bleaching process may also comprise one or more water washes or alternatively, each stage may comprise a water wash as a final step of the stage. Thus, a representative pulp bleaching sequence in which pulp is bleached using three chlorine dioxide stages and two alkaline extraction stages may be represented as D-E-D-E-D. Similarly, a pulp bleaching sequence wherein pulp is subjected to an alkaline oxygen delignification stage, an enzymatic treatment stage, three chlorine dioxide bleaching stages and two alkaline extraction stages wherein each stage is followed by a water wash may be represented by O-X-D-E-D-E-D.

It is common for mills to perform an alkali-oxygen delignification stage prior to carrying out chemical bleaching of pulp. This process consists of reacting the pulp with oxygen and alkali at high temperatures (approximately 100° C.) for a period of about one hour. Alkali-oxygen delignification reduces the amount of lignin in the pulp by 35-50%, but this process is harsh on the pulp and is often accompanied by destruction of some of the cellulose fibers in the pulp. Following alkali-oxygen delignification, the pulp is washed as described earlier to remove solubilized lignin.

The next bleaching stage after alkali-oxygen delignification is usually chemical bleaching with oxidative chemicals, the most prominent being chlorine dioxide ($ClO_2$). However, several processes have been described which may facilitate or enhance bleaching of pulp prior to chemical bleaching. For example, an enzymatic treatment stage with xylanase may be used to enhance the bleaching of pulp prior to chemical bleaching.

Xylanases are used in the pulp and paper industry to enhance the bleaching of pulp and to decrease the amount of chlorinated chemicals used in bleaching stages (Erickson, 1990; Paice et al., 1988; Pommier et al., 1989). There have been several mechanisms proposed for the bleaching action of xylanase. One is that lignin is connected to crystalline cellulose through xylan and xylanase enzymes facilitate bleaching of pulp by hydrolysing xylan, releasing coloured lignin from the pulp. A second proposed mechanism is that xylanase removes xylan thereby improving the alkali extractability of the pulp. Regardless of the mechanism, xylanase treatment allows subsequent bleaching chemicals such as chlorine, chlorine dioxide, hydrogen peroxide, or combinations of these chemicals to bleach pulp more efficiently than in the absence of xylanase. Pretreatment of pulp with xylanase prior to chemical bleaching increases the whiteness and quality of the final paper product and reduces the amount of chlorine-based chemicals which must be used to bleach the pulp. This in turn decreases the chlorinated effluent produced by such processes.

Xylanases have been isolated from a variety of organisms including bacteria and fungi. Generally, fungal xylanases exhibit optimal activity at acidic pHs, in the range of about 3.5 to 5.5, and a temperature of about 50° C. In contrast, bacterial xylanases exhibit optimal activity at pH 5 to pH 7 and a temperature optimum between 50° C. and 70° C. However, there are other xylanase enzymes which exhibit optimal activity under other conditions. For example, U.S. Pat. No. 5,405,789 to Campbell et al., discloses construction of thermostable mutants of low molecular mass xylanase from *Bacillus circulans*. U.S. Pat. No. 5,759,840 to Sung et al., discloses modification of a family 11 xylanase from *Trichoderma reesei* to improve thermophilicity, alkalophilicity and thermostability as compared to the natural xylanase. U.S. Pat. No. 5,916,795 to Fukunaga et al., discloses a thermostable xylanase from *Bacillus*. A publication entitled "Xylanase Treatment of Oxygen-Bleached Hardwood Kraft Pulp at High Temperature and Alkaline pH Levels Gives Substantial Savings in Bleaching Chemicals" to Shah et al., (J. of Pulp and Paper Science, vol 26 No. 1 January 2000, which is herein incorporated by reference) discloses treating oxygen delignified hardwood pulp with xylanase from *Thermotoga maritima* at pH 10 and 90° C. and subsequently bleaching the pulp. These documents disclose using xylanases to enzymatically treat pulp prior to chemical bleaching. However, none of these documents suggest using xylanases to treat pulp after a chemical bleaching stage.

The next stage in a typical pulp bleaching process is usually chlorine dioxide bleaching with chlorine dioxide, chlorine or in some instances, a combination of chlorine dioxide and other oxidative bleaching agents. For example, the first chlorine dioxide stage in a chemical bleaching process is often called the $D_o$ or D100 stage. Subsequent chlorine dioxide bleaching stages are referred to as $D_1$, $D_2$ and so on. For mills that bleach pulp without an alkali-oxygen delignification stage, the $D_o$ stage is the first chemical bleaching stage. The $D_o$ stage is usually carried out at pH 1.5 to 3.0. In a small but decreasing number of mills, up to 30% to 50% chlorine gas may be added to $ClO_2$ in an effort to achieve a higher efficiency of lignin removal. Such a stage is referred to as a $C_D$ stage. After a $D_o$ or $C_D$ stage, the pulp is washed with water, and alkaline extracted. Alkaline extraction is carried out by adjusting the pH of the pulp to 9.0 to 12.0 with sodium hydroxide or sodium carbonate at a temperature between 60° C. to 120° C. for a period of 30 to 90 minutes. After the alkaline extractions stage, the pulp is washed with water. The sequence of chlorine dioxide bleaching stage, wash and alkaline extraction is repeated until the pulp is suitably bleached. In most cases, two to three rounds of acidic and alkaline bleaching, alternating between chlorine dioxide stages and alkaline extraction stages, are required before the pulp is suitably bleached.

In all present commercial applications, xylanase use comprises a xylanase treatment stage prior to the first chlorine dioxide stage. This results in a pulp with increased brightness compared to pulp treated in a similar manner but without xylanase treatment. Alternatively, a specific brightness level can be achieved using a smaller amount of bleaching chemicals when the pulp is treated with xylanase prior to bleaching, compared to pulp that is not treated with xylanase before bleaching.

U.S. Pat. No. 5,645,686 discloses a process for bleaching a chemical paper pulp by means of a sequence of treatment stages involving at least one stage with hydrogen peroxide and at least one stage with a peroxyacid. The patent also discloses a xylanase treatment stage in combination with the pulp bleaching sequence. The patent does not suggest subjecting pulp to a xylanase treatment stage after a chlorine dioxide stage in a pulp bleaching process which employs only chlorine dioxide bleaching stages. Further, there is no teaching as to whether a xylanase treatment stage after a first chlorine dioxide bleaching stage may be more effective in enhancing the bleaching of pulp compared to a pulp bleaching sequence wherein xylanase treatment is performed prior to the first chlorine dioxide bleaching stage.

WO 91/05908 discloses a process for producing bleached lignocellulosic pulp having reduced organically bound chlorine and reduced brightness reversion. The process entails treating pulp with xylanase after a chemical bleaching stage which primarily employs chlorine. The reference teaches that xylanase treatment after a chlorine bleaching stage is not as effective at bleaching pulp as xylanase treatment prior to a chlorine bleaching stage. The reference does not address whether a chlorine dioxide bleaching stage, as employed now by most mills, followed by a xylanase treatment stage may be capable of enhancing the bleaching of pulp.

A publication entitled Xylanase Pre- and Post-treatments of Bleached Pulps Decrease Absorption Coefficient by Wong et al., (2000. J. of Pulp and Paper Science Vol 26 No. 10 377-383, which is herein incorporated by reference) teaches xylanase treatment of pulp as a final stage of a partial or complete chemical bleaching process. However, the reference teaches that xylanase treatment of pulp after chemical bleaching increases the brightness of pulp by a smaller amount than does conventional xylanase treatment of pulp before chemical bleaching.

While the xylanase treatments in pulp bleaching processes generally result in enhanced pulp bleaching compared to equivalent pulp bleaching processes which do not comprise xylanase treatment, there is a need in the art to increase the efficiency of the xylanase treatment. The pulp industry is under pressure to decrease the use of chlorine-containing bleaching chemicals, such as chlorine and chlorine dioxide, and thus, any method or process which can be integrated into a pulp bleaching process to reduce the use of chlorine-containing bleaching chemicals or the toxic effluents produced by the use of such chemicals would be an important and valuable asset to the pulp industry. The industry would also save money by using less chemicals such as, chlorine dioxide in bleaching stages, and sodium hydroxide and hydrogen peroxide in alkaline extraction stages. Improving the efficiency of xylanase treatment would address these concerns by further decreasing chemical usage.

There is a need in the art for novel methods and more efficient methods of bleaching pulp. Further, there is a need in the art for methods, or processes which can be integrated into existing pulp bleaching processes to increase the efficiency of the bleaching process and reduce the use of chlorine containing bleaching compounds or the toxic effluents produced by the use of such chemicals. There is also a need to save money by decreasing chemical usage.

It is an object of the invention to overcome drawbacks in the prior art.

The above object is met by a combination of the features of the main claims. The sub claims disclose further advantageous embodiments of the invention.

SUMMARY OF THE INVENTION

The invention relates to methods of bleaching pulp. More specifically the invention relates to methods of bleaching pulp using xylanase.

According to the present invention, there is provided a method of bleaching chemical pulp comprising the steps of:

a) exposing chemical pulp to a chlorine dioxide bleaching stage to produce a partially bleached pulp;
b) treating the partially bleached pulp with a xylanase in a mild extraction stage, at a pH of about 3 to 8, more preferably about 5 to 8; and
c) exposing the enzymatically treated pulp to a second chlorine dioxide bleaching stage without an alkaline extraction stage between the first chlorine dioxide bleaching stage and the second chlorine dioxide bleaching stage.

The method of the invention replaces the conventional alkaline extraction stage, which typically takes place at pH 10.0-12.5 at 70° C. to 120° C., with a much milder extraction stage. In the presence of xylanase, the extraction stage takes place at near neutral to acid pH, at temperatures as low as 60° C. By using a mild extraction stage, a mill may decrease the use of sodium hydroxide, or other alkali used to achieve high pH. The mill also decreases the use of bleaching chemicals such as chlorine dioxide. The mill also avoids the harsh extraction conditions that can destroy or degrade the cellulose fibers, thus permitting production of a pulp with a higher strength and/or a higher yield than conventionally produced pulps.

The pulp bleaching method may be performed in a mill as part of a larger pulp bleaching process. Further, the chemical pulp may comprise kraft pulp, soda pulp or sulfite pulp.

Also according to the method of the present invention as defined above, the first bleaching step may be preceded by an alkaline oxygen delignification stage.

Any xylanase active at conditions of the mild extraction stage may be employed in the method of the present invention. For example, but not to be considered limiting, the xylanase may be selected from the group consisting of wild-type *Trichoderma reesei* xylanase II, TrX-HML-AHAE, TrX-HML-GHAE, TrX-HML-ARAE, TrX-HML-GRAE, TrX-HML-GPHAE, and TrX-HML-GPRAE.

According to a further aspect of the present invention there is provided a method of bleaching chemical pulp comprising the steps of:

a) treating chemical pulp with a first xylanase in a first enzyme treatment stage to produce an enzyme treated pulp;
b) exposing the enzyme treated pulp to a first chlorine dioxide bleaching stage to produce a partially bleached pulp; and
c) treating the partially bleached pulp with a second xylanase in a mild extraction stage at a pH of about 3 to 8, preferably about 5 to 8; and
d) exposing the enzymatically treated pulp to a second chlorine dioxide bleaching stage without an alkaline extraction stage between the first chlorine dioxide bleaching stage and the second chlorine dioxide bleaching stage.

Also according to the method of the present invention as defined above, the first step of treating the chemical pulp with a first xylanase in a first enzyme treatment stage may be preceded by an alkaline oxygen delignification stage.

Further, according to the present invention as defined above, the first xylanase may be different from the second xylanase or the first xylanase may be identical to the second xylanase. The first xylanase or the second xylanase may be selected from the group consisting of TrX-HML-AHAE xylanase which is commercially available from Iogen Corporation, and wild-type *Trichoderma reesei* xylanase II, or other suitable xylanase. Further, the conditions of the first enzyme treatment stage may be different from the conditions of the second enzyme treatment stage or the conditions of the first enzyme treatment stage may be identical to conditions in the second enzyme treatment stage.

Also according to the method of the present invention as defined above, the method may be followed by one or more enzyme treatment stages, chemical bleaching stages, water washes, and extraction stages. Thus, the pulp bleaching method of the present invention may form part of a more elaborate or complex pulp bleaching process.

The pulp bleaching method of the present invention enhances pulp bleaching compared to conventional pulp bleaching processes known in the art. Further, the pulp bleaching method of the present invention is easily integrated into pulp bleaching processes which are currently practised in the art.

The chlorine dioxide bleaching stages used within the method as described above, may comprise chlorine dioxide or chlorine dioxide and at least one other bleaching agent selected from the group consisting of chlorine, ozone, hydrogen peroxide or a combination thereof, such that chlorine dioxide is the more abundant bleaching agent in the chlorine dioxide bleaching stage. Chlorine dioxide bleaching may be performed at a pH between about 1 and about 5, but preferably about 1.5 to about 3.

Also, according to the method of the present invention as defined above, the step of treating chemical pulp with a xylanase in an enzyme treatment stage may be preceded by an alkaline oxygen delignification stage.

Further, according to the present invention, there is provided a pulp bleaching process comprising a sequence selected from the group consisting of:

a) Do-X-D-E-D;
b) Do-X-D-X-D;
c) Do-X-D-D;
d) O-Do-X-D-E-D;
e) O-Do-X-D-D;
f) Do-Xop-D-E-D;
g) X-Do-Xop-D-E-D; and
h) X-Do-X-D-E-D wherein, Do is a chlorine dioxide bleaching stage,
X is a mild extraction xylanase treatment stage,
D is a chlorine dioxide bleaching stage,
E is an alkali extraction stage, and
Xop is a mild extraction stage comprising xylanase, oxygen and hydrogen peroxide.

This summary does not necessarily describe all necessary features of the invention but that the invention may also reside in a sub-combination of the described features.

DESCRIPTION OF PREFERRED EMBODIMENT

The invention relates to methods of bleaching pulp. More specifically the invention relates to methods of bleaching pulp using xylanase.

The following description is of a preferred embodiment by way of example only and without limitation to the combination of features necessary for carrying the invention into effect.

In one embodiment of the present invention, there is provided a method of bleaching chemical pulp comprising the steps of:

a) exposing chemical pulp to a chlorine dioxide bleaching stage to produce a partially bleached pulp;
b) treating the partially bleached pulp with a xylanase in a mild extraction stage at pH about 3 to 8, preferably about 5 to 8, to produce an enzymatically treated pulp; and
c) exposing the enzymatically treated pulp to a second chlorine dioxide bleaching stage without an alkaline extraction stage between the first chlorine dioxide bleaching stage and the second chlorine dioxide bleaching stage.

It is preferred that the first chlorine dioxide bleaching stage comprises a water wash as a final step of the stage prior to the step of treating the partially bleached pulp with a xylanase in the mild extraction stage. More preferably, both chlorine dioxide bleaching stages and the mild extraction stage comprise a water wash as a final step of each stage. Further, the pulp bleaching method of the present invention may be performed in a mill as part of a complex pulp bleaching process.

The present invention also pertains to a method of bleaching chemical pulp as outlined above, wherein some of the bleaching stages comprise peroxyacid.

By the term "chemical pulp" it is meant any type of virgin fiber, secondary fiber, woody or nonwoody fiber, softwood, hardwood or a mixture thereof which has been treated by chemical pulping such as, but not limited to, kraft pulp, soda pulp or sulfite pulp and is subsequently in a form suitable for bleaching. Preferably, the chemical pulp comprises virgin fiber. Chemical pulp also includes kraft pulp, soda pulp or sulfite pulp which has been exposed to an alkali oxygen delignification stage prior to practising the method of the present invention. The alkaline oxygen delignification stage is preferably followed with a water wash prior to the first chlorine dioxide stage. Other conditions associated with the production of chemical pulp, including kraft and sulfite pulps are described in "Pulp Bleaching: Principles and Practice" (edited by Dence and Reeve, 1996; which is herein incorporated by reference).

By the term "chlorine dioxide bleaching stage" it is meant treating pulp with chlorine dioxide, or chlorine dioxide in combination with chlorine, ozone, hydrogen peroxide, both chlorine and ozone or chlorine and hydrogen peroxide. Preferably, chlorine dioxide is the more abundant bleaching agent in the chlorine dioxide bleaching stage. Other aspects of chlorine dioxide bleaching which may be used in the method of the present invention are described in Dence and Reeve (1996, "Pulp Bleaching: Principles and Practice").

In a preferred embodiment, the first chlorine dioxide bleaching stage is performed at a pH in the range of about 1 to about 5, preferably about 1.5 to about 3. The temperature of the stage is preferably 50° C. to 75° C., and the reaction time is 5 minutes to 60 minutes. The amount of chlorine dioxide added to the pulp is 5 to 25 kilograms per tonne of pulp. These conditions are similar to the first chlorine dioxide bleaching stage in a pulp mill, as would be known to one of skill in the art.

The mild extraction stage is run at a pH of about 3 to 8. In this range, a significantly lower amount of sodium hydroxide or other alkali is required to adjust the pH of the pulp, as compared with a conventional alkaline extraction at pH 10 to 12.5, and from 70° C. to 120° C. Preferably, the pH of the mild extraction stage is about pH 5 to 8 and most preferably pH 7 to 8. The pH is measured at the end of the stage, at the end of the tower or in the washer vat. The pulp consistency is preferably 5% to 10%.

The mild extraction stage optionally includes hydrogen peroxide, oxygen, or a combination of these compounds that are often found in a conventional alkaline extraction stage. When oxygen is used, it is preferably added at a level corresponding to 3 to 9 kg per tonne pulp. Hydrogen peroxide is preferably used at a level of 2 to 7 kg per tonne pulp. Performance additives such as magnesium sulfate, that are often used in conventional alkaline extraction stages, may also be used in mild extraction stages.

The mild extraction stage is preferably run at a temperature of 50° C. to 80° C. Any xylanase which is capable of hydrolyzing xylan and enhancing the bleaching of pulp under the conditions of the mild extraction stage may be used in the method of the present invention. The xylanase must be active at the pH and temperature of the stage, and be resistant to oxygen, hydrogen peroxide, and additives that may be present.

The xylanase dosage is preferably 0.5 to 2.0 xylanase units per gram of pulp. Methods of measuring xylanase units are described in Example 2.

Both wild-type and genetically modified xylanases may be employed in the method of the present invention. For example, but not wishing to be limiting, xylanases which may be useful in the method of the present invention include fungal xylanases which exhibit optimal activity at acidic pHs in the range of about 3.5 to about 5.5 and at temperatures of about 50° C., and bacterial xylanases which exhibit optimal activity at pH 5 to 7 and temperatures between about 50° C. and 70° C. Also, the present invention contemplates using other xylanase enzymes under other conditions such as, but not limited to wild-type, thermostable and alkalostable xylanases as taught in U.S. Pat. No. 5,405,789 which discloses mutants of low molecular mass from *Bacillus circulans*, and U.S. Ser. No. 60/213,803 to Sung (which is herein incorporated by reference), which discloses xylanases having increased thermophilicity and alkalophilicity relative to the wild-type *Trichoderma* xylanase, or wild-type thermophilic enzyme. Further, other xylanases which may be useful in the method of the present invention include thermostable xylanases such as *Caldocellum saccharolyticum, Thermotoga maritima* and *Thermotoga* sp. Strain FJSS-B.1 (Lüthi et al. 1990; Winterhalter et al. 1995; Simpson et al. 1991; which are herein incorporated by reference). The method of the present invention further contemplates the use of xylanases derived from, but not limited to *Trichoderma reesei* xylanase I, *Trichoderma viride* xylanase, *Streptomyces lividans* xylanase B, *Streptomyces lividans* xylanase C, or other non-family 11 xylanases, for example, but not wishing to be limiting, *Caldocellum saccharolyticum, Thermotoga maritima* and *Thermotoga* sp. Strain FJSS-B.1.

Genetically modified variants of these xylanases also may be used in combination or alone in the enzyme treatment stages of the present invention provided they are capable of enhancing the bleaching of pulp, that is enhancing removal of lignin from pulp under the conditions of the mild extraction stage. Genetically modified variants might have superior ability to act over a wider range of pH, temperature, or concentration of oxygen or hydrogen peroxide than the corresponding wild-type xylanase.

As is evident to someone of skill in the art, some native xylanases exhibit both xylanase and cellulase activities. The additional cellulolytic activity is undesirable for pulp bleaching due to its detrimental effect on cellulose, the bulk material in pulp fibres. It is preferred that the method of the present invention use one or more xylanases which lacks cellulolytic activity or is reduced in cellulolytic activity. Preferably, the method of the present invention uses one or more xylanases that have reduced or impaired cellulase activity.

After the mild extraction stage, the amount of lignin associated with pulp may be estimated by determining the kappa number of the pulp, which may be performed according to Example 1. A method, process or step which reduces the kappa number of the pulp by a greater amount than another method, process, or step may be considered to be more effective in removing lignin associated with pulp and thus, is more effective in enhancing the bleaching of pulp.

The second chlorine dioxide stage is carried out using procedures familiar to those skilled in the art, and described in Dence and Reeve. Preferably, this stage is run at a pH of 3 to 6, a temperature of 60° C. to 90° C., and a time of 1 to 4 hours. The use of a mild extraction stage may decrease the amount of acid, if required to adjust the pH in the second chlorine dioxide stage.

In practicing the present invention there is no alkaline extraction stage between the first and second chlorine dioxide stages. An alkaline extraction stage is well known in the art to take place at pH 8.5 to 13, most often pH 9 to 11, at 60° C. to 90° C. or up to 120° C. in "hot" alkaline extractions. The mild extractions of the present invention occur in a lower pH range than a conventional alkaline extraction.

After the second chlorine dioxide stage, the brightness of the pulp may be determined according to Example 7. A method, process or step that produces a pulp with a higher ISO brightness number than another method, process or step is more effective in enhancing the bleaching of pulp.

According to the present invention, there is provided a method of bleaching chemical pulp with xylanase. In an aspect of an embodiment of the present invention, there is provided a method of bleaching chemical pulp comprising the steps of:

a) treating the chemical pulp with a first xylanase in a first enzyme treatment stage to produce an enzyme treated pulp, b) exposing the enzyme treated pulp to a chlorine dioxide bleaching stage to produce a partially bleached pulp; and c) treating the partially bleached pulp with a second xylanase in a second enzyme treatment stage at a pH of about 3 to 8, preferably about 5 to 8; and d) exposing the enzymatically treated pulp to a second chlorine dioxide bleaching stage without an alkaline extraction stage between the first chlorine dioxide bleaching stage and the second chlorine dioxide bleaching stage.

The first xylanase treatment stage may be preceded by an alkaline oxygen delignification stage.

The first xylanase employed in the first enzyme treatment stage may be identical to the second xylanase used in the second enzyme treatment stage, or the first xylanase may be different from the second xylanase. Further, the conditions of the first enzyme treatment stage may be identical or dissimilar to the conditions in the second enzyme treatment stage. Conditions of the enzyme treatment stage include, but are not limited to temperature, pH, incubation time, amount of xylanase used, components of the incubation medium, and pulp consistency. As would be evident to someone of skill in the art, it is preferred that the conditions of an enzyme treatment stage are compatible with the xylanase enzyme or enzymes used in that enzyme treatment stage. Specifically, the conditions of each enzyme treatment stage should allow the xylanase used in the enzyme treatment stage to exhibit more than about 10% of its maximum activity, and more preferably greater than about 30% of its maximum activity under the conditions of the enzyme treatment stage. Thus, it may be possible that an extremely alkalophilic xylanase used in the first enzyme treatment stage may exhibit less than 10% of its maximum activity under the conditions of the second enzyme treatment stage, that is under pH conditions between 3 and 8. It is preferred that such an alkalophilic xylanase is not used in the second enzyme treatment stage. The activity of a xylanase may be determined by any method known in the art, for example, but not limited to the assays described in Example 2.

Without wishing to be limiting, the first xylanase, second xylanase or both xylanases may comprise the wild-type *Trichoderma reesei* xylanase or a genetically modified variant thereof such as, but not limited to, TrX-HML-AHAE*,
TrX-HML-GHAE*,
TrX-HML-ARAE*,
TrX-HML-GRAE*,
TrX-HML-GPHAE*, or
TrX-HML-GPRAE*, (* disclosed in WO 01/92487; which is incorporated herein by reference), or other modified xylanases disclosed in WO 01/92487 that exhibit properties of a xylanase as defined above. The xylanase may also comprise *Actinomadura flexuosa* xylanase A as described in U.S. Pat. No. 5,935,836 (herein incorporated by reference) as a 35 kDa xylanase.

The pulp bleaching method of the present invention enhances pulp bleaching compared to conventional pulp bleaching processes known in the art. Further, the pulp bleaching method of the present invention is easily integrated into pulp bleaching processes which are currently practised in the art.

Representative pulp bleaching sequences contemplated by the present invention are described in FIG. 1. The pulp bleaching sequences are for illustrative purposes only and are not meant to limit the invention in any manner. The method of the present invention contemplates pulp bleaching sequences comprising a chlorine dioxide stage, followed by a mild extraction stage with xylanase treatment, followed by a chlorine dioxide bleaching stage (Do-X-D) without an alkaline extraction stage intervening between the two chlorine dioxide stages. This is represented by bleaching sequences such as, but not limited to:

Do-X-D-E-D,
Do-X-D-X-D,
O-Do-X-D-E-D,
O-Do-X-D-X-D,
Do-X-D-D,
O-Do-X-D-D,
Do-Xop-D-E-D,
X-Do-Xop-D-E-D, and
X-Do-X-D-E-D, wherein, Do is a chlorine dioxide bleaching stage,
X is a mild extraction xylanase treatment stage,
D is a chlorine dioxide bleaching stage,
E is an alkali extraction stage, and
Xop is a mild extraction stage comprising xylanase, oxygen and hydrogen peroxide.

Further, a pulp bleaching sequence comprising two or more stages denoted by the same character may be performed under identical or dissimilar conditions. For example, but not wishing to be limiting, a pulp bleaching sequence comprising three D stages may comprise identical or different treatment conditions in each stage. In the case of a xylanase treatment stage which is practised after a chlorine dioxide bleaching stage in a pulp bleaching sequence, such as, but not limited to Do-X-D-E-D and Do-X-D-X-D pulp bleaching sequences, the xylanase treatment stage may replace an alkaline extraction stage. In such an embodiment, replacing an alkaline extraction stage with a xylanase. treatment stage may reduce the usage of base, such as, but not limited to sodium hydroxide for pH adjustment of the pulp.

It is also contemplated by the method of the present invention that an enzyme treatment stage comprising xylanase, which is performed after a chlorine dioxide bleaching stage may replace an alkaline extraction stage. For example, but not wishing to be limiting in any manner, a pulp bleaching sequence of the present invention, such as, but not limited to Do-X-E-D-E-D may be modified to Do-X-D-E-D or Do-X-D-X-D. These pulp bleaching sequences, and others that describe similar bleaching sequences are contemplated by the method of the present invention. In all of the pulp bleaching sequences described above, a mild extraction stage, which is performed after a chlorine dioxide bleaching stage, is performed at a pH of about 3 to 8.

Referring now to Table 2 (Example 8), there is shown the effect of treating pulp with a mild extraction stage comprising xylanase following a chlorine dioxide bleaching stage as contemplated in the pulp bleaching sequences of the method of the present invention. Specific details of the pulp bleaching sequences are described in Example 8.

The results in Table 2 show that a xylanase untreated control pulp bleaching sequence (Do-E) requires a sodium hydroxide charge of about 1.2% (w/w) relative to the mass of the pulp to adjust the pH of the pulp to about 11.2 in an alkaline extraction stage following a chlorine dioxide bleaching stage. The pulp bleaching sequence (Do-E) produces a pulp having a kappa number of about 6.3. Treating pulp with a xylanase enxyme, for example but not limited to, i) TrX-HML-AHAE xylanase at a pH of about 6.8 (Do-X) after a chlorine dioxide bleaching stage requires a sodium hydroxide charge of about 0.2% (w/w) relative to the mass of the pulp. The pulp bleaching sequence produces a pulp having a kappa number of about 5.4.

ii) HTX-18 xylanase at a pH of about 7.2 (also Do-X) after a chlorine dioxide bleaching stage requires a sodium hydroxide charge of about 0.2% (w/w) relative to the mass of the pulp. The pulp bleaching sequence produces a pulp having a kappa number of about 6.1.

iii) ECOPULP TX-1200C xylanase at a pH of about 6.8 (also Do-X) after a chlorine dioxide bleaching stage requires a sodium hydroxide charge of about 0.2% (w/w) relative to the mass of the pulp. The pulp bleaching sequence produces a pulp having a kappa number of about 5.7.

iv) ECOPULP TX-1200C xylanase at a pH of about 7.2 (also Do-X) after a chlorine dioxide bleaching stage requires a sodium hydroxide charge of about 0.3% (w/w) relative to the mass of the pulp. The pulp bleaching sequence produces a pulp having a kappa number of about 5.5.

The results shown in Table 2 suggest that xylanase treatment of pulp after a chlorine dioxide bleaching stage in accordance with the method of the present invention reduces the amount of base, such as, but not limited to NaOH which is required to adjust the pH of the pulp to between about 9 and about 12, which is typical of most alkaline extraction stages. Further, Table 2 suggests that a mild extraction stage with xylanase treatment may replace an alkaline extraction stage and yield a pulp that is brighter than a pulp which is treated in an alkaline extraction stage in the absence of xylanase. Such an enzyme-treated, mildly extracted pulp which is bleached without an alkaline extraction stage may result in a higher pulp strength, yield, or both, compared to a conventionally bleached pulp.

The method of the present invention is also illustrated in Table 1 (Example 6), which shows mild extraction stages in the presence of xylanase, oxygen and hydrogen peroxide. These "Xop" stages can outperform conventional Eop stages while decreasing the use of sodium hydroxide. For example in the case presented in Table 1, the amount of sodium hydroxide is decreased by about 50%, while achieving equivalent bleached brightness values. A saving in amount of $ClO_2$ is also observed with a Xop stage.

The method of the present invention is also illustrated in Table 3 (Example 9), which shows mild extraction stages in the presence of xylanase, oxygen and hydrogen peroxide, in comparison with conventional xylanase stages. The mild extraction stages comprising xylanase (Xop) perform as well as conventional extraction stages, however the amount of sodium hydroxide required to achieve the same bleached brightness levels is significantly decreased. Furthermore, there is a decrease in the amount of $ClO_2$ needed to achieve similar bleached brightness levels in the use of an Xop stage.

The method of the present invention comprises treating partially bleached pulp with a xylanase in a mild extraction stage at a pH of about 3 to 8. As is evident to someone of skill in the art, the pH of the mild extraction stage may change during the stage. Thus, the method of the present invention also contemplates mild extraction stages which commence at an initial pH outside of about 3 to about 8 and which finish at a pH inside a pH range of about 3 to about 8.

The above description is not intended to limit the claimed invention in any manner. Furthermore, the discussed combination of features might not be absolutely necessary for the inventive solution.

The present invention will be further illustrated in the following examples. However, it is to be understood that these examples are for illustrative purposes only, and should not be used to limit the scope of the present invention in any manner.

EXAMPLE 1

Determination of Kappa Number

The kappa number of the pulp is determined using the protocol described in: TAPPI method for Kappa number of pulp (T 236 cm-85) from TAPPI Test Methods 1996-1997, which is herein incorporated by reference. Briefly, the kappa number is the volume (in milliliters) of a 0.1 N potassium permanganate solution consumed by one gram of moisture-free pulp under the conditions specified in the method. The results are corrected to 50% consumption of the permanganate added.

The kappa number determination is performed at a constant temperature of 25° C.±0.2° C. with continuous agitation. However, it is possible to correct for variations in temperature as is described below.

The moisture content of the pulp is determined in accordance with TAPPI T 210 "Sampling and Testing Wood Pulp Shipments for Moisture" which is herein incorporated by reference. Briefly, the pulp specimen is disintegrated in about 800 mL of distilled water and stirred. 100 mL of 0.1 N potassium permanganate and 100 mL of 4N sulfuric acid (bringing the total volume to about 1 L) are added to the slurry and allowed to react for 10 minutes. At the end of the 10 minute period, the reaction is stopped by adding 20 mL of 1.0 N potassium iodide and the solution is titrated with 0.2 N sodium thiosulfate.

The kappa number of the pulp may be calculated using the following formula:

$$K=(p\times f)/w$$

wherein:

$$p=(b-a)N/0.1,$$

and wherein;

K is the kappa number;

f is the factor for correction to a 50% permanganate consumption, depending on the value of p ($f=w*10^{(0.00093\times(p-50))}$);

w is the weight in grams of moisture-free pulp in the specimen;

p is the amount of 0.1 N potassium permanganate solution consumed by the test specimen in mL;

b is the amount of the thiosulfate solution consumed in a blank determination in mL;

a is the amount of thiosulfate solution consumed by the test specimen in mL; and N=normality of the thiosulfate solution.

Correction of the kappa number of the pulp for determinations made at temperatures between 20° C. and 30° C. may be made using the formula:

$$K=p\times f(1+0.013(25-t))/w$$

wherein t is the actual reaction temperature in degrees Celsius, and p, f, and w are as defined above.

EXAMPLE 2

Standard Assay for the Measurement of Xylanase Activity

Xylanase Assay #1:

The endo xylanase assay is specific for endo-1,4-beta-D-xylanase activity. On incubation of azo-xylan (oat) with xylanase, the substrate is depolymerized to produce low-molecular weight dyed fragments which remain in solution on addition of ethanol to the reaction mixture. High molecular weight material is removed by centrifugation, and the colour of the supernatant is measured. Xylanase activity in the assay solution is determined by reference to a standard curve.

Substrate: The substrate is purified (to remove starch and beta-glucan). The polysaccharide is dyed with Remazolbrilliant Blue R to an extent of about one dye molecule per 30 sugar residues. The powdered substrate is dissolved in water and sodium acetate buffer and the pH is adjusted to 4.5.

Assay: Xylanase is diluted in 0.5M acetate buffer at pH 4.5. Two millilitres of the solution is heated at 40° C. for 5 minutes. 0.25 mL of pre-heated azo-xylan is added to the enzyme solution. The mixture is incubated for 10 minutes. The reaction is terminated and high molecular weight substrate is precipitated by adding 1.0 mL of ethanol (95% v/v) with vigorous stirring for 10 seconds on a vortex mixer. The reaction tubes are allowed to equilibrate to room temperature for 10 minutes and are then centrifuged at 2000 rpm for 6-10 minutes. The supernatant solution is transferred to a spectrophotometer cuvette and the absorbance of blank and reaction solutions measured at 590 nm. Activity is determined by reference to a standard curve. Blanks are prepared by adding ethanol to the substrate before the addition of enzyme.

The following assay may also be used to quantify xylanase activity.

Xylanase Assay #2:

The quantitative assay determines the number of reducing sugar ends generated from soluble xylan. The substrate for this assay is the fraction of birchwood xylan which dissolves in water from a 5% suspension of birchwood xylan (Sigma Chemical Co.). After removing the insoluble fraction, the supernatant is freeze dried and stored in a dessicator. The measurement of specific activity is performed as follows: Reaction mixtures containing 100 μL of 30 mg/mL xylan previously diluted in assay buffer (50 mM sodium citrate, pH 5.5 or the pH optimum of the tested xylanase), 150 μL assay buffer, and 50 μL of enzyme diluted in assay buffer were incubated at 40° C. (or the temperature optimum of the tested xylanase). At various time intervals 50 μL portions are removed and the reaction is stopped by diluting in 1 mL of 5 mM NaOH. The amount of reducing sugars is determined using the hydroxybenzoic acid hydrazide reagent (HBAH) (Lever, 1972, Analytical Biochem 47: 273-279). A unit of enzyme activity is defined as that amount generating 1 μmol reducing sugar in 1 minute at 40° C. (or at the optimum pH and temperature of the enzyme).

EXAMPLE 3

Preparation of Chlorine Dioxide

Chlorine dioxide was made in the lab by the standard procedure of passing a mixture of chlorine gas and nitrogen through a series of columns containing sodium chlorite, and collecting the evolved gas in cold water. The chlorine dioxide was stored refrigerated at a concentration of 10.4 grams per litre in water. Further details regarding the preparation of chlorine dioxide may be found in Chlorine Dioxide Generation published by Paprican, Pointe Claire, Quebec (which is herein incorporated by reference).

EXAMPLE 4

Conventional Xylanase Treatment of Pulp

This is the procedure for carrying out conventional xylanase treatment, prior to bleaching of the pulp in a Do stage. A 15 g pulp sample having a predetermined kappa number is adjusted to a consistency of 10% (wt/vol) with deionized water and the pH of the pulp is adjusted between 6.8 and 7 with a 10% solution of $Na_2CO_3$. The pulp sample is heated to 57° C. prior to adding TrX-HML-AHAE xylanase, which is commercially available from Iogen Corporation. Enzyme is added to samples and the pulp samples are incubated at 57° C. for 60 minutes. Following the incubation period the reaction is stopped by lowering the pH to between 2.5 and 3 by the addition of hydrochloric acid and by cooling the samples in an ice water bath.

The enzyme dose is 0.5 to 2.0 units of xylanase activity (measured according to the first xylanase assay described in Example 2) per gram of pulp. For comparative purposes, pulp samples may be mock-treated under conditions which lack xylanase to facilitate comparison of the different bleaching sequences.

EXAMPLE 5

Chlorine Dioxide Bleaching of Hardwood Pulp Samples

Pulp samples are subjected to chlorine dioxide bleaching stages which are similar to those described in Glossary of Bleaching Terms CPPA technical section, which is herein incorporated by reference, describing optimum conditions of 1.0%-2.3% $ClO_2$ on pulp, 40-60° C., 3-10% pulp consistency, 30-60 minute incubation period, pH 2.5 to 3.0.

Chlorine Dioxide Bleaching (Do) Stage

The first chlorine dioxide bleaching stage is the Do stage. The pulp mixture is cooled to 4° C. to minimize evaporation prior to chlorine dioxide addition. $ClO_2$ is added to the pulp and the system is maintained in a heat-sealable plastic bag. Pulp kappa factors of 0.15, 0.17, 0.19 and 0.21 are used to calculate the chlorine dioxide charge required in the bleaching stage. The chlorine dioxide charge may be determined using the following formula:

$$\text{Chlorine dioxide charge (kg/ton pulp)} = 10 \times \text{kappa factor} \times \text{kappa number}/2.63$$

Based on a kappa factor of 0.17 and a pulp kappa number of 13.9, the corresponding chlorine dioxide usage is 9 kg/ton pulp. After $ClO_2$ addition, the pulp comprises 4% consistency, pH 2.5 to 3.0. The bags are placed in a 50° C. water bath for 60 minutes. Following the incubation period, pulp samples are washed with 2L of tap water. Subsequently, Do pulp samples are subjected to a mild extraction with xylanase (X), or subjected to a conventional alkaline extraction stage (Eop).

Mild Extraction (Xop)

Xylanase treatments in mild extraction Xop stages are carried out as described in Example 4, with the following changes. The pulp samples are subjected to a mild extraction stage (Xop) after the first chlorine dioxide bleaching stage (Do). The Xop stage comprises incubating pulp samples at 60° C., 10% (wt/vol) consistency, with a sodium hydroxide charge of 0.2-0.4%, a hydrogen peroxide charge of 0.3% (wt/wt) and an oxygen pressure of 5 psig, to consume 6 kg oxygen per tonne pulp, for 60 minutes. The pH of the extraction medium is about 7.5 at the end of the incubation. Following the incubation period, each pulp sample is washed with 2L of tap water.

Alkaline Extraction Stage (Eop)

After the first chlorine dioxide bleaching stage (Do), the control pulp samples are subjected to an alkaline extraction stage (Eop). The Eop stage comprises incubating pulp samples at 75° C., 10% (wt/vol) consistency, with a sodium hydroxide charge of 1.2%, a hydrogen peroxide charge of 0.3% (wt/wt) and an oxygen pressure of 5 psig, to consume 6 kg oxygen per tonne pulp, for 60 minutes. The pH of the extraction medium is about 11.5 at the end of the incubation. Following the incubation period, each pulp sample is washed with 2L of tap water.

Chlorine Dioxide Bleaching ($D_1$) Stage

Regardless of whether the extraction stage is mild or conventional, all pulps are subjected to similar $D_1$ stages. The $D_1$ stage is performed in a similar manner to the Do stage. Briefly, pulp samples are adjusted to a consistency of 10% (wt/vol) and incubated at pH 3.6 to about 4, 75° C. for 180 minutes. The $D_1$ chlorine dioxide charges are chosen to correspond with kappa factors of 0.11, 0.13, 0.15 and 0.17. Following the incubation period, each pulp sample is washed with 2L of tap water. Following the extraction the brightness of the pulp may be measured according to Example 7. This is the $D_1$ brightness of the pulp. The pulp may be further bleached by performing a second extraction stage and a third chlorine dioxide bleaching stage.

Second Extraction Stage ($E_2$)

Following the $D_1$ stage the pulp is subjected to a second extraction stage. The extraction stage comprises incubating pulp at 75° C. for 90 minutes with a 1% NaOH charge. The pulp consistency is 10% (wt/vol) and the pH of the pulp following the incubation period is about 11.3. Following the extraction stage, each pulp sample is washed with 2L of tap water.

Chlorine Dioxide Bleaching ($D_2$)Stage

The $D_2$ stage is performed in a similar manner to the other chlorine dioxide bleaching stages. The pulp samples are adjusted to a consistency of 10% (wt/vol). The chlorine dioxide charge is 0.29% (w/w) for each sample. Samples are incubated at 75° C. for a period of 180 minutes. The final pH of the chlorine dioxide bleaching stage is about pH 4.

Following the Chlorine Dioxide Bleaching ($D_2$) stage, the brightness of the pulp may be measured according to Example 7. This is the $D_2$ brightness of the pulp.

EXAMPLE 6

Mild Extraction with Xylanase to Decrease Use of Sodium Hydroxide and Chlorine Dioxide Unbleached hardwood kraft pulp (kappa number 15.6) from a mill in Quebec was subjected to D stages as described in Example 5. Following this, the pulp was subjected to mild X extraction stages as in Example 5, using 1 IU/g of TrX-HML-AHAE xylanase, from Iogen Corporation, or 1 IU/g of *Actinomadura flexuosa* xylanase A produced as described in U.S. Pat. No. 5,935,836. Control pulps were subjected to conventional Eop stages as described in Example 5. Following the mild or conventional extractions, the pulps were fully bleached using DED sequences described in Example 5.

The results are shown in Table 1. The use of mild extraction stages containing xylanase can increase the bleached brightness of the pulp, at a wide range of bleaching chemical charges, as reflected by Total Kappa factor. The mild extraction stages also decrease the use of sodium hydroxide and of chlorine dioxide, thereby offering the mill the possibility of decreasing bleaching chemical costs.

TABLE 1

Bleaching with mild extraction stages

| Parameter | Conventional extraction DoEopDED | TrX-HML-AHAE xylanase DoXopDED | *Actinomadura flexuosa* xylanase-A DoXopDED |
|---|---|---|---|
| Bleached brightness | | | |
| TKf 0.35 | 85.6 | 85.8 | 86.3 |
| TKf 0.40 | 85.8 | 86.7 | 86.8 |
| TKf 0.45 | 86.8 | 87.4 | 87.6 |
| TKf 0.50 | 87.7 | 87.5 | 87.8 |
| NaOH in Extraction, Kg/t | 10.0 | 4.3 | 4.3 |
| ClO2 to 87 Brightness, Kg/t | 23.3 | 21.2 | 20.4 |

EXAMPLE 7

Measuring Pulp Brightness

Pulp brightness is measured according to the method disclosed by PAPTAC-Standard Testing Methods July, 1997 (Standard E1 Brightness of Pulp, Paper and Paperboard, which is herein incorporated by reference).

Briefly, a 3.75 g sample of pulp is used to form a brightness pad. A pulp sample is. placed in a 500 mL container and water is added to about 200 mL. About 2 mL of sulfuric acid solution is added to each jar and the contents mixed well. A pad is formed by pouring the pulp into a funnel under vacuum and subsequently pressing the pad with a plunger. Each pad is pressed between blotters using a hydraulic press. The pulp pad is allowed to dry overnight at room temperature.

ISO Brightness Determination

Brightness is measured using an Elrephometer. The sample is diffusely illuminated using a highly reflecting, integrated sphere. Reflected light is measured at right angles to the sample. Reflectance is compared to absolute reflectance based on a perfectly reflecting, perfectly diffusing surface which is considered to exhibit a brightness of 100%. Magnesium oxide is one standard which is used to compare to pulp brightness. A blue light of wavelength 457 nm is used for the brightness reading.

EXAMPLE 8

Mild Extraction with Xylanase to Decrease Use of Sodium Hydroxide

Unbleached hardwood pulp having a kappa number of 14.9 was obtained from a mill in Quebec. The pulp is washed with water and adjusted to a pH between 2.5 to 3.0 using HCl. Several 10 gram samples of pulp are subjected to a chlorine dioxide (Do) bleaching stage according to the Glossary of Bleaching Terms of the CPPA technical section, which is herein incorporated by reference describing optimum conditions of 1.0%-2.3% $ClO_2$ on pulp, 3-10% pulp consistency, 30-60 minute incubation period, pH 2.5-3.0. Briefly, $ClO_2$ is added to the pulp and the system is maintained in a heat-sealable plastic bag. The pulp mixture is cooled to 4° C. to minimize evaporation before $ClO_2$ addition. The kappa factor is recommended to be about 0.17 to avoid formation of furans and dioxins (Glossary of Bleaching Terms of CPPA Technical Section, which is incorporated herein by reference). The chlorine dioxide charge may be estimated using the formulas in Example 5.

Based on a kappa factor of 0.17, the corresponding chlorine dioxide charge is 9.6 kg/ton pulp. After $ClO_2$ addition, the pulp comprises 4% consistency. The bags are placed in a 50° C. water bath for 60 minutes.

After the D stage, the pulp is washed with tap water over a vacuum funnel. The pulp is adjusted to 10% consistency with deionized water. For enzyme-treated pulps, a mild extraction was carried out as described in Example 5, with the following exceptions.

For the first enzyme-treated pulp, the initial pH of the pulp is adjusted to 6.7 with sodium hydroxide. The pulp is heated to 60° C. and a xylanase enzyme, TrX-HML-AHAE, available commercially from Iogen Corporation, is added to the pulp. The enzyme dosage is 0.7 units per gram of pulp. The pulp bag is placed in a 60° C. water bath for 1 hour.

For the second enzyme-treated pulp, the initial pH of the pulp is adjusted to 7.4 with sodium hydroxide. The pulp is heated to 60° C. and a xylanase enzyme, HTX18, available commercially from Iogen Corporation, is added to the pulp. The enzyme dosage is 0.8 units per gram of pulp. The pulp bag is placed in a 60° C. water bath for 1 hour.

For the third enzyme-treated pulp, the initial pH of the pulp is adjusted to pH 7.4 with sodium hydroxide. The pulp is heated to 60° C. and xylanase from *Actinomadura flexuosa* xylanase A, produced as described in U.S. Pat. No. 5,935,836 is added to the pulp. The enzyme dose is 0.7 units per gram of pulp. The pulp bags are placed in a 60° C. water bath for 1 hour.

For the fourth enzyme-treated pulp, the initial pH of the pulp is adjusted to 6.7 with sodium hydroxide. The pulp is heated to 60° C. and xylanase from *Actinomadura flexuosa* xylanase A, produced as described in U.S. Pat. No. 5,935,836 is added to the pulp. The enzyme dosage is 0.7 units per gram of pulp. The pulp bags are placed in a 60° C. water bath for 1 hour.

For the untreated control pulps, conventional extraction was carried out as described in Example 5, with the following exceptions. The initial pH of the pulp is adjusted to 11.4 with sodium hydroxide. The pulp is heated to 60° C., and the pulp bags are placed in a 60° C. water bath for 1 hour.

After incubation, all pulps are subsequently washed with tap water, and the kappa number of the pulp is determined. The results are shown in Table 2.

TABLE 2

Bleaching using a Conventional extraction stage (E), or a mild extraction stage with xylanase (X)

| Bleaching sequence | Enzyme in mild extraction | Kappa Number | NaOH (% w/w on pulp) |
|---|---|---|---|
| DoE | Untreated control, pH 11.2 extraction | 6.3 | 1.2 |
| DoX | TrX-HML-AHAE, pH 6.8 | 5.4 | 0.2 |
| DoX | HTX-18, pH 7.2 | 6.1 | 0.2 |
| DoX | *Actinomadura flexuosa* xylanase A, pH 6.8 | 5.7 | 0.2 |
| DoX | *Actinomadura flexuosa* xylanase A, pH 7.2 | 5.5 | 0.3 |

These results show that it is possible to use mild extraction stages with xylanase enzymes and decrease the use of sodium hydroxide. The kappa number of the pulp after the mild extraction stage with xylanase is lower than the kappa number after the conventional extraction stage. This indicates that a further savings in chlorine dioxide is possible.

EXAMPLE 9

Mild Extraction with Xylanase-Comparison with Conventional and Double Xylanase Stages Unbleached hardwood kraft pulp (kappa number 15.6) from a mill in Quebec was subjected to a conventional enzyme treatment (X) stage as described in Example 4, using 0, 0.5, or 1 iu/g of TrX-HML-AHAE at pH 6.5, 55° C., for 1 hour. This pulp was then subjected to Do stages as described in Example 5. Following this, the pulp was subjected to mild Xop extraction stages using 0, 0.5, or 1 IU/g of TrX-HML-AHAE xylanase, from Iogen Corporation, as described in Example 5. Control pulps were subjected to conventional D and E stages without xylanase treatment as described in Example 5. Following the mild or conventional extractions, the pulps were fully bleached using DED sequences described in Example 5.

The results are shown in Table 3. The use of mild extraction stages containing xylanase can increase the bleached brightness of the pulp, at a wide range of bleaching chemical charges, as reflected by Total Kappa factor. The mild extraction stages also decrease the use of sodium hydroxide and chlorine dioxide, thereby offering the mill the possibility of decreasing bleaching chemical costs.

TABLE 3

| Parameter | Bleaching with mild extraction stages | | | |
|---|---|---|---|---|
| | Conventional extraction DoEopDED | Trx-HML-AHAE xylanase DoXopDED | Conventional TrX-HML-AHAE xylanase XDoEopDED | TRX-HML-AHAE EB xylanase XDoXopDED |
| Xylanase on brownstock, (iu/g) | 0.0 | 0.0 | 1.0 | 0.5 |
| Xylanase in Xop (IU/g) | 0.0 | 1.0 | 0.0 | 0.5 |
| Total Xylanase (IU/g) | 0.0 | 1.0 | 1.0 | 1.0 |
| Final pH of Eop or Xop | 11.5 | 7.4 | 11.5 | 7.4 |
| Temperature (° C.) of Eop or Xop | 75 | 60 | 75 | 60 |
| Bleached brightness | | | | |
| TKf 0.35* | 85.6 | 85.8 | 85.9 | 86.1 |
| TKf 0.40 | 85.8 | 86.7 | 86.8 | 87.2 |
| TKf 0.45 | 86.8 | 87.4 | 87.7 | 88.3 |
| TKf 0.50 | 87.7 | 87.5 | 87.9 | 88.9 |
| NaOH in Extraction (Kg/t) | 10.0 | 4.3 | 10.0 | 4.3 |
| ClO2 to 87 Brightness, Kg/t) | 23.3 | 21.2 | 20.9 | 18.9 |

*Total kappa factor (TKf) includes a small contribution by hydrogen peroxide.

The results shown in Table 3 indicate that single (Xop) and multiple (X, and Xop) xylanase treatments in mild extraction stages are more effective than bleaching sequences that do not comprise an Xop stage. Furthermore, the above results demonstrated that multiple xylanase-treatments may be more effective than a single xylanase treatment when a fixed amount of xylanase is used for the entire bleaching process, while a similar degree of bleached brightness is obtained with less NaOH and $ClO_2$.

The mild extraction stage offers opportunities beyond that of a conventional xylanase treatment stage. The mild extraction stage, with xylanase, has similar bleached brightness as the conventional xylanase stage. However, the mild xylanase extraction stage also saves a significant amount of sodium hydroxide for pH adjustment.

The combination of a conventional xylanase treatment and a mild extraction stage is especially beneficial to the mill. The benefits include a higher degree of chlorine dioxide savings and also sodium hydroxide savings, with the same xylanase dosage as with conventional or mild extraction treatment on its own.

All references are herein incorporated by reference.

The present invention has been described with regard to preferred embodiments. However, it will be obvious to persons skilled in the art that a number of variations and modifications can be made without departing from the scope of the invention as described herein.

REFERENCES

Ericksson, K. E. L., (1990) Wood Science and Technology 24; 79-101.

Lüthi, E., Jasmat, N. B., and Bergquist, P. L. (1990) Appl. Environ. Microbiol. 56:2677-2683.

Paice, M. G., R. Bernier, and L. Jurasek, (1988) Biotechnol. and Bioeng. 32,235-239.

Pommier, J. C., J. L. Fuentes, and G. Goma, (1989) Tappi Journal, 187-191.

Reeve and Dence (1996) Pulp Bleaching Principles and Practice. Tappi Press, Atlanta, Ga.

Simpson, H. D., Haufler, U. R., and Daniel, R. M. (1991) Biochem. J. (1991) 277:413-417.

Winterhalter C. and Liebl, W. (1995) Appl. Environ. Microbiol. 61:1810-1815.

The embodiments of the invention in which an exclusive property of privilege is claimed are defined as follows:

1. A method of bleaching chemical pulp comprising the steps of:

a) treating chemical pulp in a first chlorine dioxide bleaching stage and then washing the pulp with a first water wash to produce a partially bleached pulp;

b) treating said partially bleached pulp with a xylanase directly subsequent to said first chlorine dioxide bleaching stage and said first water wash to hydrolyze xylan present in said partially bleached pulp, and then washing the pulp with a second water wash to produce an enzymatically treated pulp, wherein said treating is carried out at a pH of between about 3 and about 8; and c) treating said enzymatically treated pulp to a second chlorine dioxide bleaching stage directly subsequent to the xylanase treatment stage and said second water wash (step b).

2. The method of claim 1, wherein said chemical pulp comprises kraft pulp, soda pulp or sulfite pulp.

3. The method of claim 1, wherein at least one of said first and second chlorine dioxide bleaching stages comprises chlorine dioxide and chlorine.

4. The method of claim 1, further comprising an oxygen delignification stage, a xylanase treatment stage, or a combination thereof, prior to said step of treating chemical pulp in the first chlorine dioxide bleaching stage (step a).

* * * * *

UNITED STATES PATENT AND TRADEMARK OFFICE

CERTIFICATE OF CORRECTION

PATENT NO. : 7,368,036 B2
APPLICATION NO. : 10/505815
DATED : May 6, 2008
INVENTOR(S) : Jeffrey S. Tolan et al.

It is certified that error appears in the above-identified patent and that said Letters Patent is hereby corrected as shown below:

ON COVER PAGE AT (75) INVENTORS

"Jeffrey S. Tolan, Ontario (CA); Corina Popovici, Ontario (CA)" should read --Jeffrey S. Tolan, Ottawa (CA); Corina Popovici, Ottawa (CA)--.

ON COVER PAGE AT (56) FOREIGN PATENT DOCUMENTS

"WO WO 9207998 5/1992 Al* 5/1992" should be deleted;
"WO WO 92/07998 5/1992" should read --WO WO 92/07998 A1* 5/1992--; and
"WO WO 9111553 A1* 8/1991" should read --WO WO 91/11553 Al* 8/1991--.

COLUMN 4

Line 9, "as," should read --as--; and
Line 19, "chlorine containing" should read --chlorine-containing--.

COLUMN 8

Line 29, "lacks" should read --lack--.

COLUMN 10

Line 39, "xylanase." should read --xylanase--.

COLUMN 11

Line 3, "enxyme," should read --enzyme,--; and "for example but not limited to," should read --for example, but not limited to (i)-(iv):--.

COLUMN 12

Line 49, "(p-50)));" should read --$^{(p-50))}$);--.

UNITED STATES PATENT AND TRADEMARK OFFICE

CERTIFICATE OF CORRECTION

PATENT NO. : 7,368,036 B2
APPLICATION NO. : 10/505815
DATED : May 6, 2008
INVENTOR(S) : Jeffrey S. Tolan et al.

It is certified that error appears in the above-identified patent and that said Letters Patent is hereby corrected as shown below:

COLUMN 16

Table 1, "Extraction, Kg/t" should read --Extraction, kg/t--;
Table 1, "ClO2 to 87 Brightness, Kg/t" should read --$ClO_2$ to 87 Brightness, kg/t--; and
Line 48, "is." should read --is--.

COLUMN 18

Line 48, "iu/g" should read --IU/g--.

COLUMN 19

Table 3, "EB" should be deleted;
Table 3, "iu/g" should read --IU/g--;
Table 3, "Extraction (Kg/t)" should read --Extraction (kg/t)--; and
Table 3, "ClO2 to 87 Brightness, Kg/t)" should read --$ClO_2$ to 87 Brightness (kg/t)--.

Signed and Sealed this

Twenty-second Day of December, 2009

David J. Kappos

David J. Kappos
*Director of the United States Patent and Trademark Office*